United States Patent [19]

Saka

[11] 4,030,535

[45] June 21, 1977

[54] MOLDING SYSTEM

[75] Inventor: Yoshimi Saka, Suzuka, Japan

[73] Assignee: Hitachi Metals, Ltd., Japan

[22] Filed: Apr. 18, 1975

[21] Appl. No.: 569,292

[30] Foreign Application Priority Data

Apr. 19, 1974 Japan ..... 49-43393
July 24, 1974 Japan ..... 49-84151

[52] U.S. Cl. ..... 164/207; 164/187; 164/322

[51] Int. Cl.[2] ..... B22C 15/08; B22C 11/10

[58] Field of Search ..... 164/187, 22, 27, 137, 164/180, 165, 186, 172, 40, 18, 323, 322, 207, 212

[56] References Cited

UNITED STATES PATENTS

| | | | |
|---|---|---|---|
| 1,676,201 | 7/1928 | Wood | 164/187 |
| 3,254,376 | 6/1966 | Burnett | 164/322 |
| 3,303,535 | 2/1967 | Rearwin | 164/172 |
| 3,556,196 | 1/1971 | Buhler | 164/187 X |
| 3,709,282 | 1/1973 | Taccone | 164/40 X |

*Primary Examiner*—Richard B. Lazarus
*Assistant Examiner*—John S. Brown
*Attorney, Agent, or Firm*—Craig & Antonelli

[57] ABSTRACT

A molding system comprising molding units mounted on a truck on rails laid at right angles to a plurality of equi-spaced, parallel pouring lines. Each molding unit consists of a flaskless molding machine and a pusher for the product molds. The molding machines are operated with different but coordinated fluid pressure settings for the drag, cope, and match plate in such a manner that those components do not put any restraint upon the movement of a squeeze table.

8 Claims, 8 Drawing Figures

MOLDING SYSTEM

This invention relates to a system of flaskless molding machinery using double-sided match plates, suited particularly for small-quantity production of diversified molds and castings.

Molding equipment is available in numerous types and sized including, for example, the molding installations provided with single-sided pattern plates which often are fully automatized. Those highly streamlined installations are generally too complex in construction and layout and too expensive for ecomonical production of varied castings in small lots. For such applications, therefore, the simpler traditional apparatus, mostly of hand-operated types, are in wide use. However, because of the shortage of labor, particularly of skilled molders, the efficiency of hand mold operation for multikind small-lot castings has been very low.

Although some automatic molding machines of the match plate type were developed to solve the foregoing problems, they have presented new difficulties, such as complication of the roll-over mechanism for packing the sand in the drag flask, and deformation of the match plate due to the half-flask sand packing. Another difficulty is involved in the use of the match plate originally designed for hand molding direct in modern automatic molding machines.

SUMMARY OF THE INVENTION

It is a primary object of this invention to provide a molding system which makes use of match plates, or double-sided pattern plates, and is especially suited for diversified small-quantity production with improved efficiency.

Another object of the invention is to provide an automatic molding machine of the flaskless type capable of directly utilizing the match plate conventionally employed in manually operated molding machines.

Yet another object of the invention is to provide an automatic flaskless molding machine wherein the match plate is floatingly held and protected against deformation during the molding operation.

The molding system in accordance with the present invention comprises unit molding machines and mold pushers both of which are carried by a truck on a track extending at right angles to a plurality of equidistantly spaced parallel pouring lines, each of the molding machines being operated with different but coordinated fluid pressure settings for the drag, cope, and match plate in such a manner that those components do not put any restraint upon the movement of the squeeze table.

Figure 1:
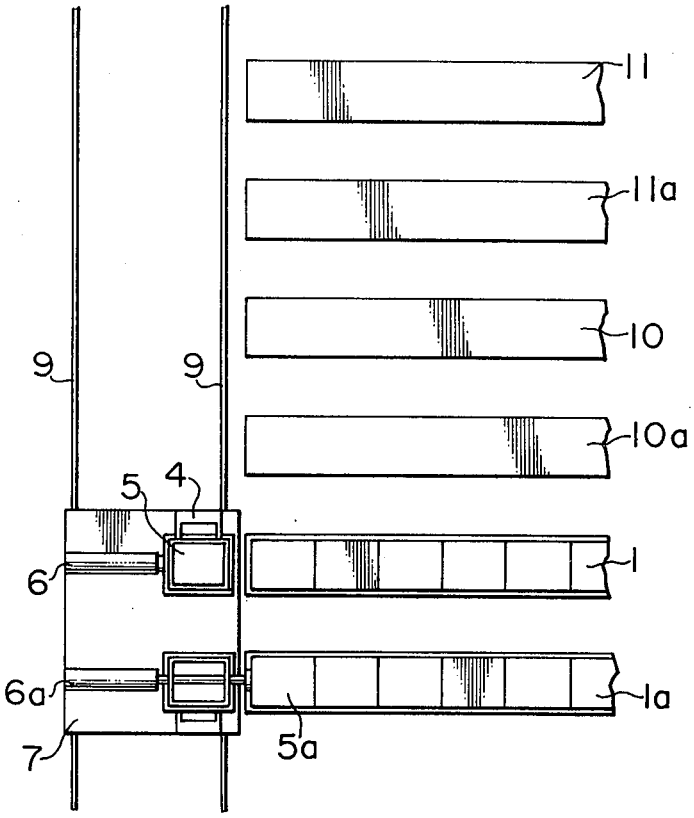
FIG. 1 is a schematic plan view of the molding system according to the present invention.
Figure 2:
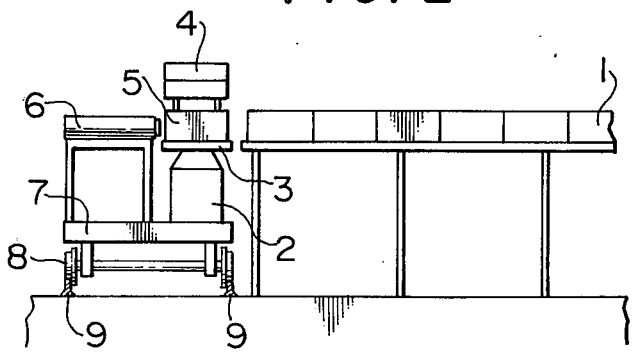
FIG. 2 is a side view of the arrangement of FIG. 1.

Referring now to the drawings, specifically to FIGS. 1 and 2 which schematically illustrate a molding installation embodying the present invention, there are shown a plurality of parallel pouring lines 1a–11, each equipped with a non-power-driven roller- or belt-conveyor. On rails 9 laid at right angles to the lines, a molding truck 7 carries two sets of molding units, each consisting of a molding machine having a cylinder assembly 2, a molding table 3, and a molding flask assembly 4, plus a pusher 6 or 6a for the delivery of product molds. These units are installed on the truck 7 in parallel and equidistantly spaced from the pouring lines. The reference numeral 5 indicates a mold being formed and the numeral 5a a finished mold being delivered to the line. 6 and 6a designate mold pushers, and 8 truck wheels.

The operation of the molding system embodying the invention will now be described. The molding truck 7 is stopped in position where the two molding units thereon are aligned to the pouring lines 1 and 1a in pair. While the operator does only such auxiliary work as core setting and push-botton control, the molding units alternately perform mold making and delivery of completed molds to the lines 1 and 1a, in succession. The line operation is so timed that while a mold is being pushed over to one line the mold fabrication for the other is near its completion, thus precluding any interruption of operation between the lines. Once a row of newborn molds have filled the entire length of the conveyor associated with each line, the addition of a new mold from the unit will force the first mold on the opposite end of the row out of the system. Aside from the delivery of the molds to but two pouring lines as above described, it is also possible, as an alternative, to move the truck from the two fully loaded lines to the next pair of lines, e.g., 10 and 10a, and repeat the foregoing procedure. In practice the molding operation may be carried out in either way or, when desired, the two alternatives may be combined to best suit the production requirements. The system of the invention will satisfy diversified conditions of multikind small-quantity production provided adequate numbers of pouring lines and trucks are chosen.

Next, the construction of the molding machine for use in the system of the invention will be described hereunder with reference to FIGS. 3 through 8 which illustrate the sequence of molding operations by the machine.

Figure 3:
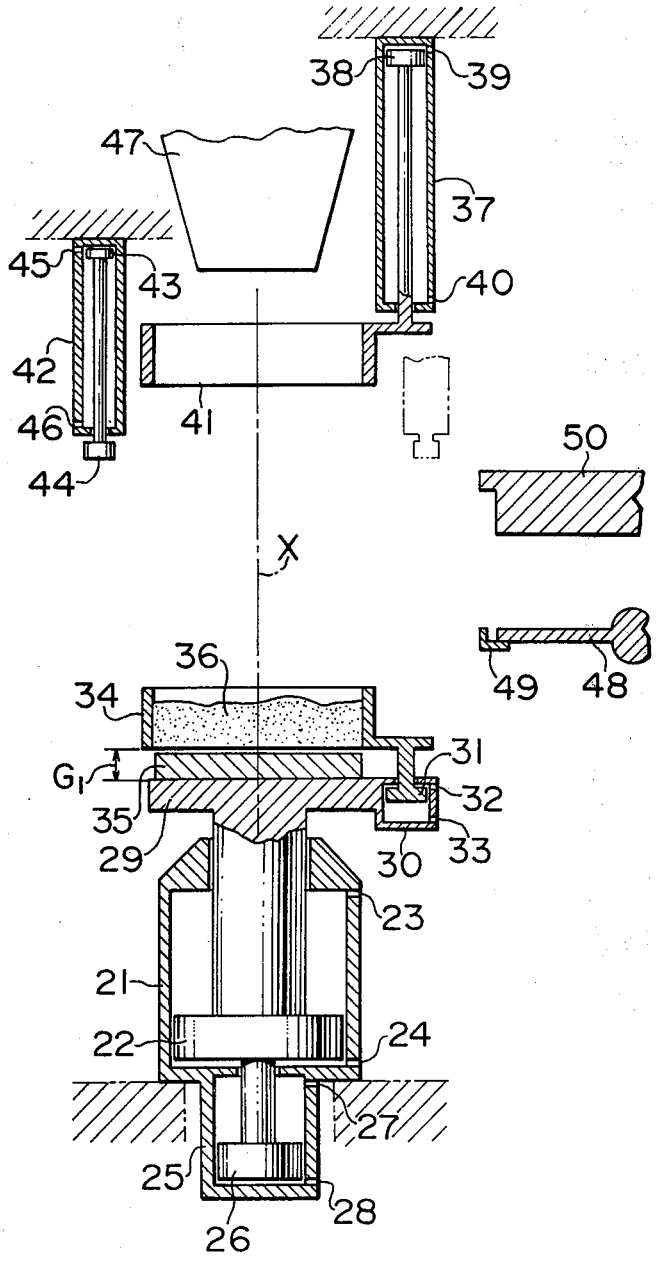
FIG. 3 is an exploded view, in section, of a unit molding machine in the system of the invention, showing the interior construction after packing of sand in the drag, the first of a series of preparatory steps for the molding operation.

Turning to FIG. 3, the relations among the working fluid pressures in cylinders will first be explained. As is usually the case with the counterparts in conventional molding machines, the squeeze cylinder 21 and the draw cylinder 25 of the machine of the invention are pneumatically operated for their upward and downward movements. A cope lift cylinder 37, a plate pusher cylinder 42, and a drag memory cylinder 30 are so constructed and arranged as to operate with different but coordinated pressure settings for their upward and downward motions, providing no restraint whatsoever upon the vertical motion of the squeeze table 29.

In order to enable the cope 41 to move down at a present velocity and also to reduce the force with which the underside of the cope presses the match plate 48 and the drag 34 downward, the air pressure for the down stroke of the cope lift cylinder 37 is set to O kg/cm² or a pressure low enough to meet the down-stroke velocity requirement (such pressure being hereinafter called a "low pressure"). On the other hand, the air pressure for the up stroke is set so that the cylinder operates with a common supply pressure (ranging from 5 to 7 kg/cm², hereinafter called a "high pressure").

The same applies, in accordance with the invention, to the pressure setting of the plate pusher cylinder 42. Like the cope lift cylinder 37, it operates with a low pressure for the down stroke and with a high pressure for the upturn.

The working air pressures for the drag memory cylinder 30 are set differently because this cylinder must keep the drag 34 in position against the downward thrust produced by the cope 41 and the plate pusher cylinder 42, and the weight of the match plate 48. In addition, the cylinder is required to put no restraint upon the displacement of the squeeze table 29 relative to the drag 34 during the process of squeezing. To meet the foregoing requirements, the air pressure for the up stroke of the drag memory cylinder 30 is set in the following way (the pressure being hereinafter referred to as an "intermediate pressure").

Assume that notation: $P_1$ = downward thrust generated by the cope lift cylinder 37; $W_1$ = weight of the cope 41; $W_1'$ = weight of sand 51 in the cope; $P_2$ = downward thrust by the plate pusher cylinder 42; $W_2$ = weight of the pusher head 44 assembly; $W_3$ = weight of the match plate 48; $W_4$ = weight of the drag 34; $P_0$ = upward thrust by the drag memory cylinder 30; and $P_S$ = upward stroke by the squeeze cylinder 21. Then, $P_0$ is set so as to satisfy the relation $$P_S \gg P_O \geqq P_1 + W_1 + W_1' + P_2 + W_2 + W_3 + w_4.$$

The down stroke of the drag memory cylinder 30 is by gravity, with the both ends of the cylinder opened to the atmospheric pressure.

As shown in FIG. 3, the squeeze cylinder 21 is supported by a foundation and houses a squeeze piston 22 slidably therein. Air holes 23, 24 formed at the upper end lower ends of the cylinder are both open to the atmospheric pressure. To the bottom of the squeeze cylinder 21 is connected to draw cylinder 25 containing a draw piston 26. Upper and lower air holes 27, 28 of the draw cylinder 25 are also open to the atmospheric pressure. To the top of the squeeze piston 22 is connected the squeeze table 29 which in turn supports the drag memory cylinder 30. An air hole 32 formed at the upper end of the memory cylinder communicates to the atmospheric pressure source, and, through a lower air hole 33, the intermediate pressure preset in the manner described is supplied so that the piston 31 slidably fitted in the drag memory cylinder 30 keeps the drag 34 in the up position. With the drag held up, there is provided a gap $G_1$ between the bottom of the drag 34 and the top of the squeeze table 29, and a mold board 35 is placed in the space. The cope lift cylinder 37, supported at the top, has an upper air hole 39 for the admission of air preset to a low pressure and a lower air hole 40 for high-pressure air. The differential pressure so produced keeps the lift piston 38 at the extremity of its up stroke, thereby suspending the cope 41 in the up position.

Similarly, the plate pusher cylinder 42 is supported at the top, and its upper air hole 45 receives air preset to a low pressure and its lower air hole 46 receives high-pressure air, so that the differential pressure raises the pusher piston 43 and therefore the pusher head 44 to the up position.

A sand feeder hopper 47, set to a center position X aligned to the axes of the drag 34 and cope 41, suspends from an upper support.

The match plate 48 rests on a plate carrier 49 movable between the center position X and a position outside of the molding flask.

Like the match plate, a squeeze board 50 is supported to be movable into and out of the center position X. FIG. 3 shows the drag 34 filled with sand 36 on the mold board 35 in the gap $G_1$.

Figure 4:
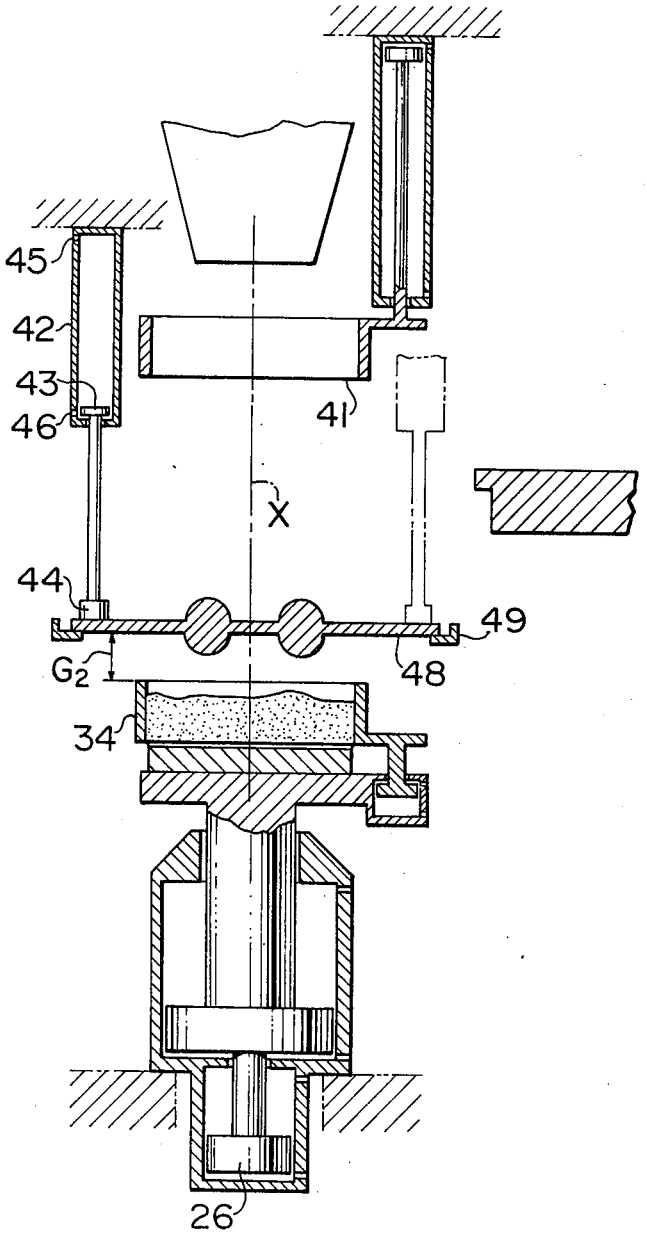
FIG. 4 is a view similar to FIG. 3 but showing the machine in the next stage; where a match plate is introduced between the flask halves.
Figure 5:
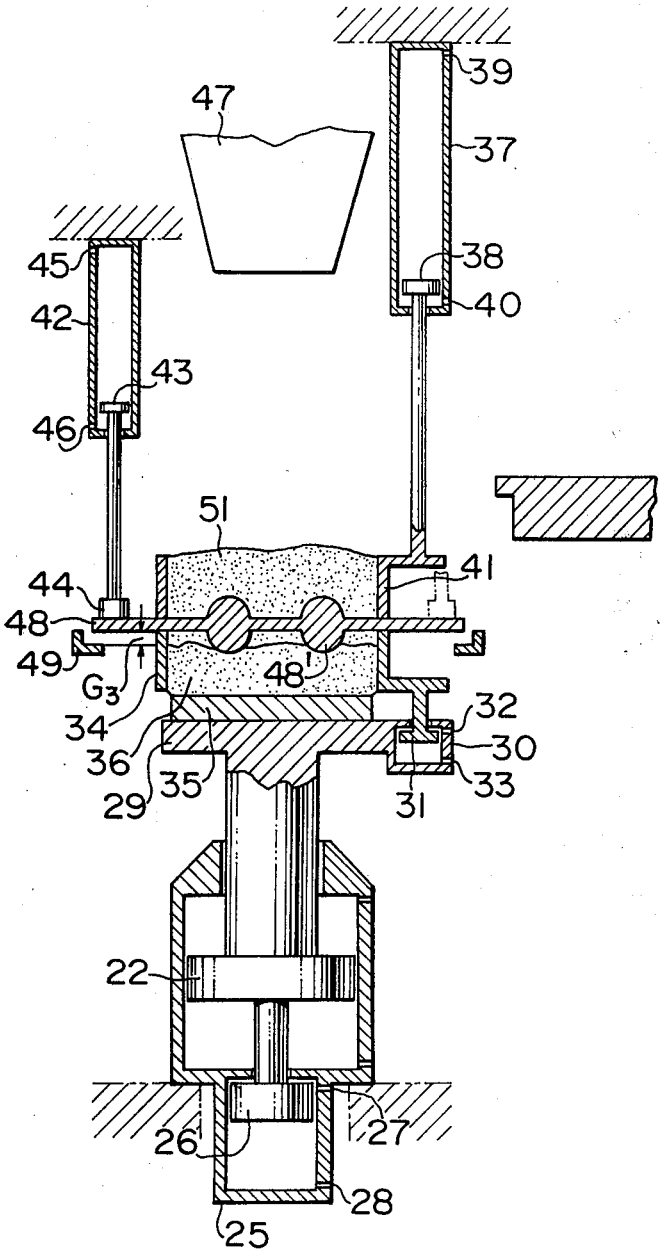
FIG. 5 shows the cope also packed with the sand following the step of FIG. 4.

In FIG. 4 the machine is shown in the stage immediately after the introduction of the match plate 48. Placed on the plate carrier 49 the match plate 48 is moved to the position X, while maintaining a gap $G_2$ between itself and the drag 34. The pusher head 44 slightly presses the match plate 48 downward as the lower air hole 46 of the plate pusher cylinder 42 is opened to the atmospheric pressure and the low-pressure air from the upper air hole 45 allows the pusher piston 43 to yield a downward thrust. Next, the draw piston 26 moves upward, lifting the drag 34 into contact with the match plate 48, to be followed by the descent of the cope 41 and filling with sand as in FIG. 5. After the cope has been filled with the sand as shown, high-pressure air is supplied to the draw cylinder 25 through the lower air hole 28, while the upper air hole 27 is opened to the atmospheric pressure. This forces the draw piston 26 and with it the squeeze piston 22 upward to raise the squeeze table 29. The drag 34, held in the up position by the drag memory cylinder 30 and the memory piston 31 supported by the table 29, then lifts the match plate 48 that has been pressed from above against the plate carrier 49 by the pusher head 44, overcoming the downward thrust of the plate pusher cylinder 42. A gap $G_3$ is thus left between the plate carrier 49 and the match plate 48. At this point, the underside of a mold pattern 48' attached to the match plate is already slightly forced into the sand 36 in the drag 34. Following this, the lower air hole 40 of the lift cylinder 37 is opened to the atmospheric pressure. The low-pressure air from the upper air hole 39 then enables the lift piston 38 to give a sufficient downward thrust to press the cope 41 against the match plate 48. Thereupon, the sand feeder hopper 47 supplies the sand 51 into the cope 41. In FIG. 5, the drag 34 is subjected to the combined downward thrust by the match plate 48, plate pusher cylinder 42, cope 41 and the associated parts. However, the drag is held in the up position because, as already stated, the downward thrust is overcome by the upward thrust of the drag memory cylinder 30 whose piston is kept in the extremity of its up stroke by the intermediate pressure.

Figure 6:
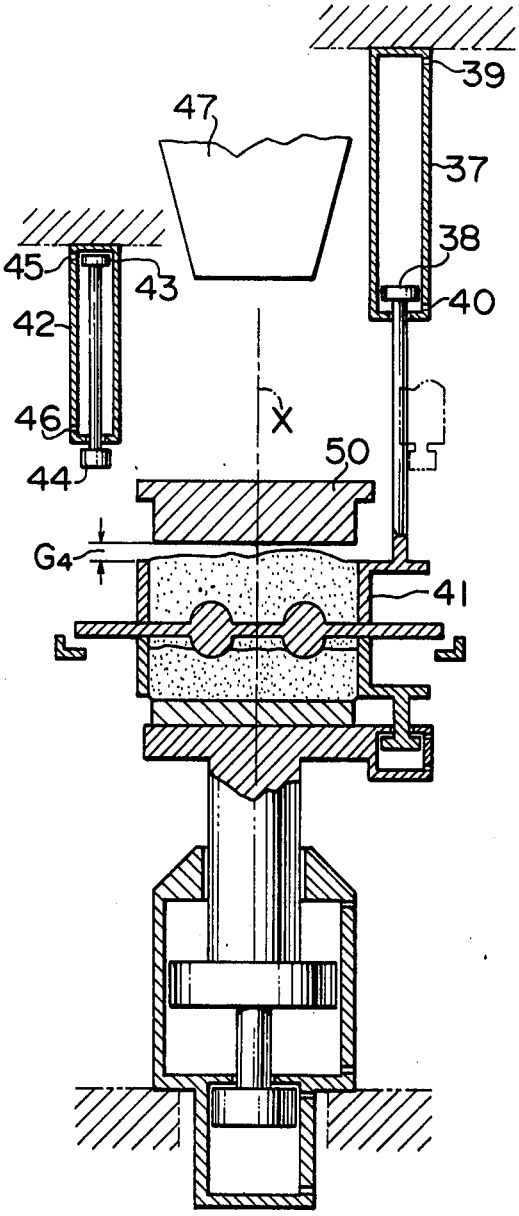
FIG. 6 shows a squeeze board being brought in position.

FIG. 6 shows the squeeze board 50 introduced into the machine. Here, as air at a high pressure is led into the plate pusher cylinder 42 through its lower air hole 46, the difference in pressure between the air and the low-pressure air from the upper air hole 45 forces the pusher piston 43 and with it the pusher head 44 upward. Next, the squeeze board 50 is brought into the position X, maintaining a gap $G_4$ between itself and the cope 41. In this state the squeeze board 50 is secured to a stationary support so as to stand the great upward thrust to be encountered during subsequent squeezing.

Figure 7:
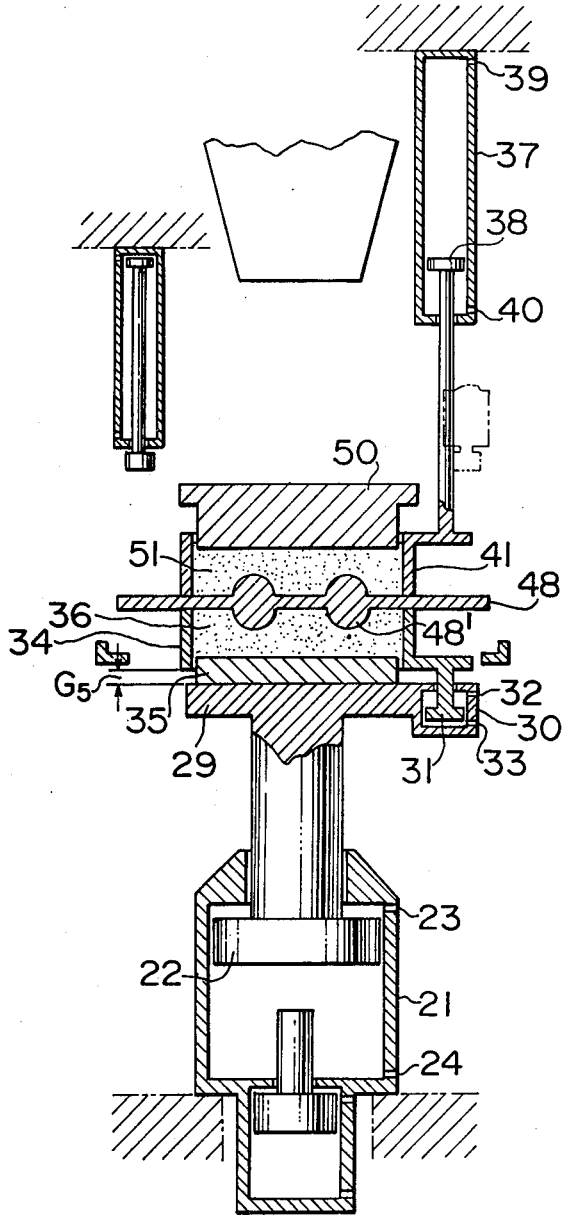
FIG. 7 shows the squeeze table in its up position for the initiation of squeezing.
Figure 8:
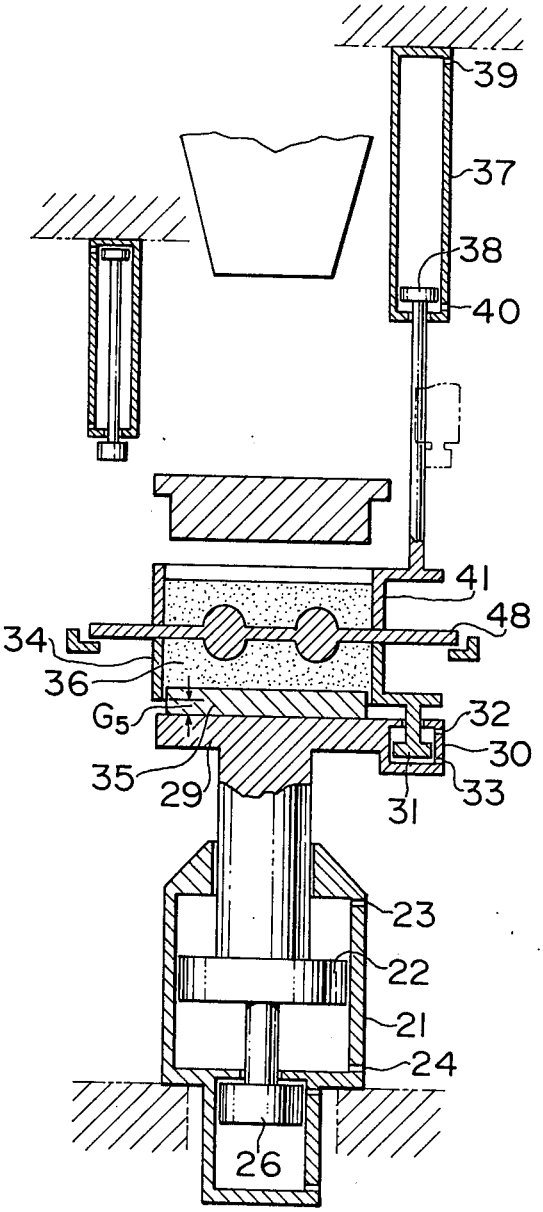
FIG. 8 shows the squeeze table in its down position after squeezing.

In the upper stage of squeezing illustrated in FIG. 7, high-pressure air is admitted to the squeeze cylinder 21 via its lower air hole 24 while the upper air hole 23 is opened to the atmospheric pressure. This causes the squeeze piston 22 to lift the squeeze table 29. The arrangement is such that, relative to the upward thrust thus produced for squeezing, the downward thrust to be generated by the cope lift cylinder 37 and the upward thrust by the drag memory cylinder 30 are both negligibly low, providing no restraint upon the upward movement of the squeeze table 29. In this way the sand 36 in the drag, the match plate 48, and the sand 51 in the cope, all held between the stationary squeeze board 50 and the mold board 35 placed on the squeeze table 29, are compressed altogether. The upward thrust created by the memory cylinder 30 supporting the drag 34 is overcome by the squeezing thrust, and the downward thrust of the cope lift cylinder 37 that forces the cope 41 downward is likewise overwhelmed by the squeezing thrust. Consequently, the mold board 35 is forced into the drag, and the squeeze board 50 into the cope, so that the sand portions 36, 51 are packed firmly around the mold pattern 48'. Next, the upper stage of squeezing, the lower air hole 33 of the drag memory cylinder 30 is opened to the atmospheric pressure, thus reducing the upward thrust of the memory cylinder to naught. As a result, the drag 34 rests on the mold board 35 via the packed and shaped sand, while leaving a gap $G_5$ between itself and the squeeze table 29. From this position the squeeze table 29 moves downward to the position as shown in FIG. 8. Both the upper and lower air holes 23, 24 of the squeeze cylinder 21 are opened to the atmospheric pressure, and the squeeze piston 22 is lowered by the weight of the squeeze table 29 and other parts thereon and by dint of the downward thrust given thereto until it is supported by the draw piston 26 in the up position.

In the state shown, the upper and lower air holes 32, 33 of the drag memory cylinder 30 are also opened to the atmospheric pressure, and the drag 34 is held by the sand 36 packed and shaped on the mold board 35 above the squeeze table 29. The cope 41 is pressed downward by the piston of the cope lift cylinder 37 into which the low-pressure air is admitted through the upper air hole. Thus the match plate 48 is held between the drag 34 and the cope 41 so as to complete squeezing. The gap $G_5$ between the drag 34 and the squeeze table 29 is kept unchanged from the dimension in the preceding stage of squeezing as shown in FIG. 7.

The procedure described above is followed by the removal of the squeeze board, cope, drag, and match plate, matching of the flask halves, removal of the flask, the delivery of the finished sand mold, and other related work to conclude the molding operation.

As has been described hereinabove, the modling machine of the present invention is constructed so that its cope, drag, match plate, and pusher head are actuated for upward and downward movements in a coordinated way by differently present fluid pressures, with no possibility of restraining the vertical movement of the squeeze table. Moreover, the relative positions of the squeeze table and the drag in the upper stage of squeezing are memorized and maintained until the squeezing is concluded. The present invention thus provides an automatic molding machine of the flaskless type capable of sand packing without roll-over, simultaneous squeezing of the cope and drag, and floating of the match plate between the flask halves, so that thin and weak match plates conventionally used in hand molding operation can be directly utilized.

I claim:

1. A molding system comprising:

a plurality of equidistantly spaced parallel pouring lines, rail means extending at a right angle to said spaced pouring lines, a truck means mounted for selective displacement along said rail means, at least one pair of flaskless molding machines mounted on said truck means such that an alignment of one of said molding machines at one of said pouring lines automatically aligns the other of said molding machines with a next adjacent pouring line, each of said molding machines including:

a drag means for receiving a material forming a portion of a product mold, a cope means arranged at the molding machine for receiving a material forming the remaining portion of the product mold, a squeeze table means arranged at the molding machine for selectively compressing the material in said drag means and said cope means, a drag memory means operatively connecting said drag means to said squeeze table means for memorizing and maintaining a predetermined relative position between said drag means and said squeeze table means at an end of a compressing operation by said squeeze table means.

and wherein each of said molding machines further include a mold pusher means for delivering a product mold from a respective molding machine to a respective pouring line.

2. A system according to claim 1, wherein each molding machine further includes a double side match plate means selectively positionable between said drag means and said cope means after said drag means has been provided with a material forming the product mold, and a piston-cylinder means operativley connected with said match plate means for providing a thrust on said match plate means in the direction of the squeeze table means such that said match plate means is maintained at a fixed position relative to the cope means and the drag means while said cope means is being provided with the material forming the product mold.

3. A system according to claim 2, wherein each of said molding machines further includes a means connected to said cope means for selectively displacing each of said cope means toward and away from said match plate means, said selective displacing means providing a thrust on said cope means and said match plate means in the direction of said squeeze table means such that said match plate means is maintained at a fixed position relative to said cope means and said drag means while said cope means is being provided with the material forming the product mold.

4. A system according to claim 3, wherein each of said means for selectively compressing further includes a squeeze board means selectively positionable above said cope means after the material forming the mold has been provided therein, said squeeze board means being stationarily mounted when positioned above said cope means such that the material in said cope means and said drag means is compressed by displacement of said squeeze table means toward said squeeze board.

5. A system according to claim 4, wherein the thrust of said match plate means piston-cylinder means and the thrust of said cope means selective displacing means are continually applied during at least a portion of the compressing operation with the thrust being such that no restraint is put upon the movement of the squeeze table means toward said squeeze board.

6. A system according to claim 1, wherein each of said molding machines includes a match plate means selectively positionable between said drag means and said cope means after said drag means has been provided with a material forming the product mold, and wherein means connected to said cope means and said match plate means are provided for applying a predetermined pressure in the direction of the squeeze table means on said cope means and said match plate means so as to maintain a fixed position of said match plate means with respect to said drag means and said cope means while said cope means is provided with the material forming the product mold, said predetermined pressure on said match plate means and said cope means being effective throughout at least a portion of the compressing operation with the predetermined pressure being selected such that the match plate means is maintained in position without restraining movement of the squeeze table means.

7. A system according to claim 1, wherein each of said drag memory means includes a cylinder means arranged on the squeeze table means, each of said drag means including a piston means selectively displaceable in said cylinder means, and means for supplying a pressure medium to said cylinder means at a pre-set pressure such that said piston means and said drag means are selectively displaced in the direction of the displacement of the squeeze table means.

8. A system according to claim 7, wherein each of said molding machines includes a match plate means selectively positionable between said drag means and said cope means after said drag means has been provided with the material forming the product mold, and wherein means connected to said cope means and said match plate means are provided for applying a predetermined pressure in the direction of the squeeze table means on said cope means and said match plate means so as to maintain a fixed position of said match plate means with respect to said drag means and said cope means while said cope means is provided with a material forming the product mold, said predetermined pressure acting upon said match plate means and said cope means being at least one of less than and equal to a pressure of the pressure medium acting upon the piston means of the drag means arranged in the drag means cylinder means.

* * * * *